US010123660B2

(12) United States Patent
Ball et al.

(10) Patent No.: US 10,123,660 B2
(45) Date of Patent: Nov. 13, 2018

(54) SHOWER DOOR ASSEMBLY

(71) Applicant: Kohler Co., Kohler, WI (US)

(72) Inventors: Matthew Ball, Sheboygan, WI (US); Mark Johnson, Plymouth, WI (US)

(73) Assignee: KOHLER CO., Kohler, WI (US)

( * ) Notice: Subject to any disclaimer, the term of this patent is extended or adjusted under 35 U.S.C. 154(b) by 230 days.

(21) Appl. No.: 14/966,657

(22) Filed: Dec. 11, 2015

(65) Prior Publication Data

US 2016/0166120 A1 Jun. 16, 2016

Related U.S. Application Data

(60) Provisional application No. 62/091,182, filed on Dec. 12, 2014.

(51) Int. Cl.

| | |
|---|---|
| ***A47K 3/34*** | (2006.01) |
| ***E05D 15/06*** | (2006.01) |
| ***E05D 15/08*** | (2006.01) |

(52) U.S. Cl.

CPC ..... *A47K 3/34* (2013.01); *E05D 15/063* (2013.01); *E05D 15/0652* (2013.01); *E05D 15/08* (2013.01); *E05Y 2201/614* (2013.01); *E05Y 2900/114* (2013.01)

(58) Field of Classification Search

CPC .... A47K 3/34; E05D 15/063; E05D 15/0652; E05D 15/08

USPC ..... 4/607

See application file for complete search history.

(56) References Cited

U.S. PATENT DOCUMENTS

| | | | |
|---|---|---|---|
| 3,384,998 | A | 5/1968 | Abramson |
| 3,956,854 | A | 5/1976 | Yamamoto |
| 4,769,949 | A | 9/1988 | Glendowne |
| 5,148,630 | A | 9/1992 | Llorens |
| 5,598,666 | A | 2/1997 | Kurth |
| 6,023,794 | A | 2/2000 | Nein |
| 6,148,451 | A | 11/2000 | DeBraal et al. |
| 6,381,904 | B1 | 5/2002 | Tedescucci |
| 2009/0038070 | A1 | 2/2009 | Belanger et al. |
| 2009/0145039 | A1 | 6/2009 | Shehoski |

(Continued)

FOREIGN PATENT DOCUMENTS

| | | |
|---|---|---|
| DE | 3837813 | 5/1990 |
| DE | 4308413 | 9/1994 |

(Continued)

OTHER PUBLICATIONS

Maax You-Tube video showing installation of Kameleon Aura Door, dated Nov. 11, 2013 and printed Feb. 23, 2018 https://www.youtube.com/watch?v=6iY9AzGli9A.*

(Continued)

*Primary Examiner* — Christine Skubinna

(74) *Attorney, Agent, or Firm* — Foley & Lardner LLP

(57) ABSTRACT

A shower door assembly includes a header, a door, and an elongated member. The header includes a track and a channel disposed above the track. The door is in moving engagement with the track. The elongated member is received within and slidably coupled to the channel and is configured to be moved within the channel between a first position to allow for removal of the door from the track, and a second position to substantially impede upright movement of the door when the door is moved along the track between an open and a closed position.

20 Claims, 6 Drawing Sheets

(56) References Cited

U.S. PATENT DOCUMENTS

| | | | | |
|---|---|---|---|---|
| 2011/0072613 | A1 | 3/2011 | Hays | |
| 2014/0173990 | A1 * | 6/2014 | Schachter | E05F 5/003 49/404 |

FOREIGN PATENT DOCUMENTS

| | | |
|---|---|---|
| DE | 19839380 | 3/2000 |
| EP | 2664262 | 11/2013 |
| FR | 2778544 | 11/1999 |

OTHER PUBLICATIONS

MAAX Bath, Inc. Product Installation Instructions.

* cited by examiner

SHOWER DOOR ASSEMBLY

CROSS-REFERENCE TO RELATED PATENT APPLICATIONS

This application claims the benefit of and priority to U.S. Provisional Application No. 62/091,182, filed Dec. 12, 2014, the entire disclosure of which is incorporated by reference herein.

BACKGROUND

Shower door assemblies typically include a header coupled between fixed portions of a shower enclosure or a portion of a building structure (e.g., a wall, a ceiling, a joist, a door frame, etc.). The header may include an internal track for receiving a door assembly. The door assembly may include a door panel and one or more rollers, such as bearing wheels or the like, for rolling engagement with the internal track of the header. Typically, the door assembly is installed in the header with the roller(s) in rolling engagement with the internal track. The door is configured to move relative to the header along the track between an open position and a closed position to allow a user to enter and exit the shower enclosure. However, with traditional shower door assemblies, when a shower door is moved between an open and a closed position, the door may sometimes move or jump in a vertical direction from the track (e.g., due to an obstruction or an object in the path of the door), thereby causing the door to derail from the track.

Some shower door assemblies include features integrated within the header for preventing the shower door from jumping and derailing from the track. However, these integrated features make it difficult to install the shower door onto the header track because the features are typically fixed at a position directly above the track and door. Furthermore, the clearance or gap between these features and the track is typically large to allow for installation of the door onto the track, which can permit an undesirable amount of vertical movement (e.g., jumping) of the door when the door is moved along the track.

It would be advantageous to provide an improved shower door assembly that includes features intended to prevent derailing of a shower door from its track. These and other advantageous features will be apparent to those reviewing the present disclosure.

SUMMARY

One embodiment relates to a shower door assembly including a header, a door, and an elongated member. The header includes a track and a channel disposed above the track. The door is in moving engagement with the track. The elongated member is received within and slidably coupled to the channel and is configured to be moved within the channel between a first position to allow for removal of the door from the track, and a second position to substantially impede upright movement of the door when the door is moved along the track between an open and a closed position.

Another embodiment relates to a shower assembly including a header and an elongated member. The header includes a track and a channel disposed above the track. The elongated member is received within and slidably coupled to the channel and is configured to be moved within the channel between a first position to allow for installation or removal of a door to or from the track, and a second position to substantially impede upright movement of the door while in moving engagement with the track.

Yet another embodiment relates to an elongated member for a shower door assembly including a side wall, a bottom wall, and a protrusion. The bottom wall extends perpendicularly from a lower portion of the side wall. The protrusion extends outwardly between the sidewall and the bottom wall, and is configured to be received within and slidably coupled to a channel of a header. The elongated member is configured to be slid within the channel between a first position to allow for installation or removal of a door onto or from the header and a second position to substantially impede upright movement of the door when the door is moved between an open and a closed position along the header.

DETAILED DESCRIPTION

Referring generally to the FIGURES, disclosed herein are shower door assemblies including an elongated member that is configured to move between two positions within a shower door header. In a first position (e.g., an installation position), a shower door can be moved in an upward direction to allow engagement or disengagement of the shower door rollers (e.g., wheels, etc.) from the track of the header, such as during installation or removal of the door onto/from the track. In a second position (e.g., a use position), the elongated member reduces (e.g., impedes, obstructs, prevents, etc.) upward and/or front-to-back movement of the door when the door is moved between an open and a closed position, because at least one of the shower door wheels is constrained by the elongated member.

For example, before a shower door is installed onto the header, a user can slide the elongated member within the header to the first position located toward an end of the header, thereby creating an installation area sufficient to facilitate installation of the door onto the header track. With the elongated member at the first position, the door can be easily installed onto the track, because the elongated member is clear of the roller(s) and other parts of the door. Once the door is installed onto the track, a user or installer can slide the elongated member within the header to the second position located between the two ends of the header. The second position within the header is such that regardless of the position of the door along the track, the roller(s) of the door nearest the center of the opening are constrained by the elongated member. That is, when the door is moved between an open and a closed position, the elongated member can act to impede upward and/or front-to-back movement of the door so as to prevent the door from derailing from the header track. In this manner, the elongated member provides flexibility for installing/removing shower doors while ensuring seamless operation of the door when the door is moved between an open and a closed position.

Figure 1:
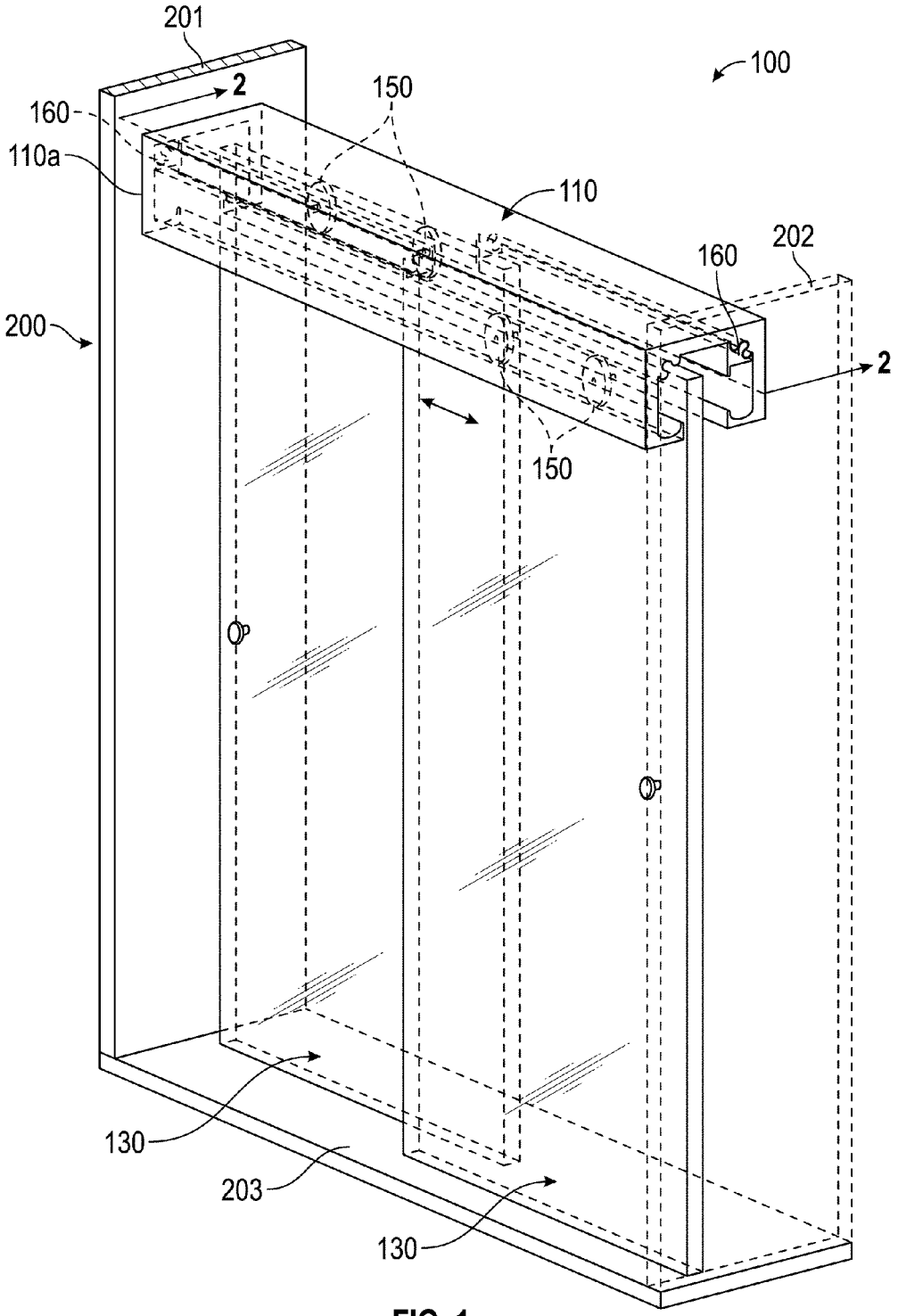
FIG. 1 is a perspective view of a shower door assembly, according to an exemplary embodiment.

Referring to FIG. 1, a shower door assembly 100 is shown according to an exemplary embodiment. The shower door assembly 100 includes a header 110 coupled to a fixed structure 200 (e.g., a wall, a ceiling, a joist, a door frame, etc.). According to an exemplary embodiment, the fixed structure 200 may be a bathing enclosure or a shower enclosure. According to other exemplary embodiments, the fixed structure 200 is a portion of a building structure or other similar type of fixed structure. In the embodiment shown in FIG. 1, the header 110 is coupled to a wall 201 of the fixed structure 200 at a first end 110*a*. The header 110 is coupled to a second wall 202 (shown in phantom) opposite the wall 201 at a second end of the header 110. As shown, the walls 201 and 202 are each coupled to a floor 203. According to other exemplary embodiments (not shown), the walls 201 and 202 are each coupled to portions of a bath tub, a platform, or another similar type of fixed structure.

As shown in FIG. 1, the assembly 100 includes one or more door panels 130 in moving engagement (e.g., rolling engagement, sliding engagement, etc.) with the header 110 by, for example, one or more rollers 150 (e.g., wheels, etc.). According to the embodiment shown in FIG. 1, the assembly 100 includes two door panels 130 arranged back-to-back within the header 110 (e.g., outer and inner shower door panels). The door panels 130 are positioned such that there is a gap or space between them to allow for relative translational movement within the header 110. According to an exemplary embodiment, each door panel 130 includes two rollers 150, although a different number of rollers 150 may be used according to other exemplary embodiments. In the embodiment shown in FIG. 1, the rollers 150 are shown as bearing wheels. However, according to other exemplary embodiments, the rollers 150 may be another type of wheel, a slider, or any other suitable element to permit movement of the door 130 relative to the header 110.

The assembly 100 further includes one or more elongated members 160 received within and slidably coupled to the header 110. The elongated members 160 are each shown at a first position (e.g., an installation position) within the header 110 in which they are positioned away from the door panels 130 toward the ends of the header 110 proximate the walls 201 and 202, respectively. In the first position shown, the elongated members 160 are clear of the rollers 150 such that an area sufficient to allow installation or removal of the door panels 130 from the header 110 is created. The elongated member 160 is configured to move within the header 110 between the first position shown and a second position (shown in FIG. 2B), where the elongated member 160 can act to substantially impede upward and/or front-to-back movement of the rollers 150.

Figure 2A:
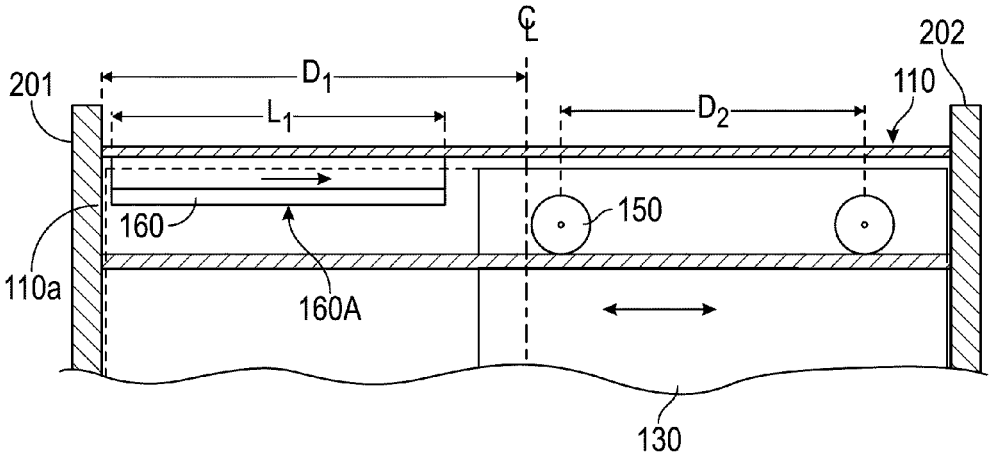
FIGS. 2A-2B are cross-sectional views taken along line 2-2 in FIG. 1 showing an elongated member at two different positions, according to an exemplary embodiment.

For example, FIG. 2A is a partial section view taken along line 2-2 in FIG. 1, with the elongated member 160 at the first position denoted by 160A within the header 110. As shown in FIG. 2A, the header 110 has a centerline located a distance $D_1$ from the first end 110*a*. The rollers 150 are located on the door panel 130 a distance $D_2$ relative to each other. The elongated member 160 has a length $L_1$ that is less than the distance $D_1$ of the header 110 such that when the elongated member 160 is at the first position 160A, the door panel 130 can be installed onto the header 110 without interference from the elongated member 160. When the elongated member 160 is at the second position 160B (shown in FIG. 2B and discussed below), the roller(s) 150 nearest the center of the opening are constrained by the elongated member 160 regardless of the position of the door panel 130 along the header 110. That is, the length $L_1$ of the elongated member 160 is short enough to allow the rollers 150 to move in an upward direction to engage/disengage the header 110 for installation/removal of the door panel 130 when the elongated member is at the first position, but is long enough to constrain the roller(s) 150 located nearest the center when the elongated member 160 is at the second position within the header 110.

Figure 2B:
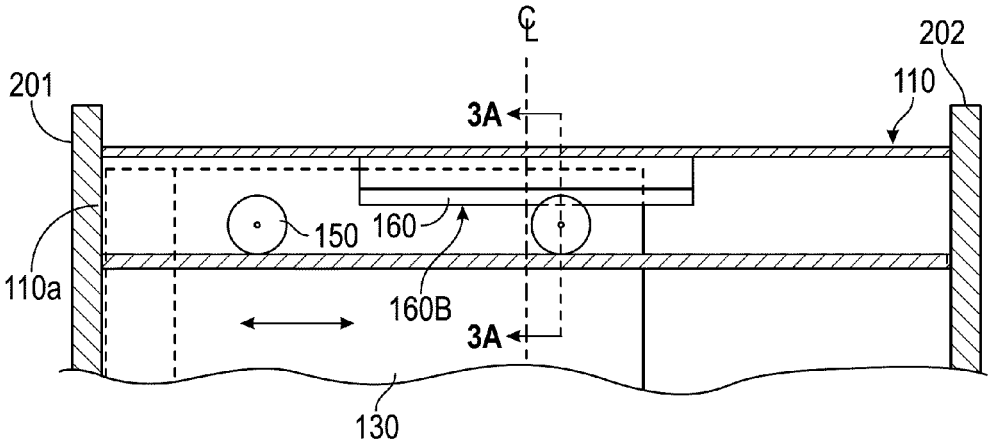

Referring to FIG. 2B, the elongated member 160 is shown at the second position denoted by 160B within the header 110. The elongated member 160 can be selectively moved (e.g., slid, etc.) within the header 110 between the first position 160A and the second position 160B (denoted by the arrow shown in FIG. 2A), for example, by a user or an installer applying a force to the elongated member 160. As shown in FIG. 2B, the elongated member 160 is disposed above the rollers 150 such that the rollers 150 located nearest the center of the header 110 are constrained by the elongated member 160. As explained above, the length $L_1$ of the elongated member 160 is such that when the elongated member is at the second position 160B, regardless of the position of the door panel 130 along the header 110 between walls 201 and 202, the roller(s) 150 located nearest the center of the opening are constrained by the elongated member 160.

Figure 2C:
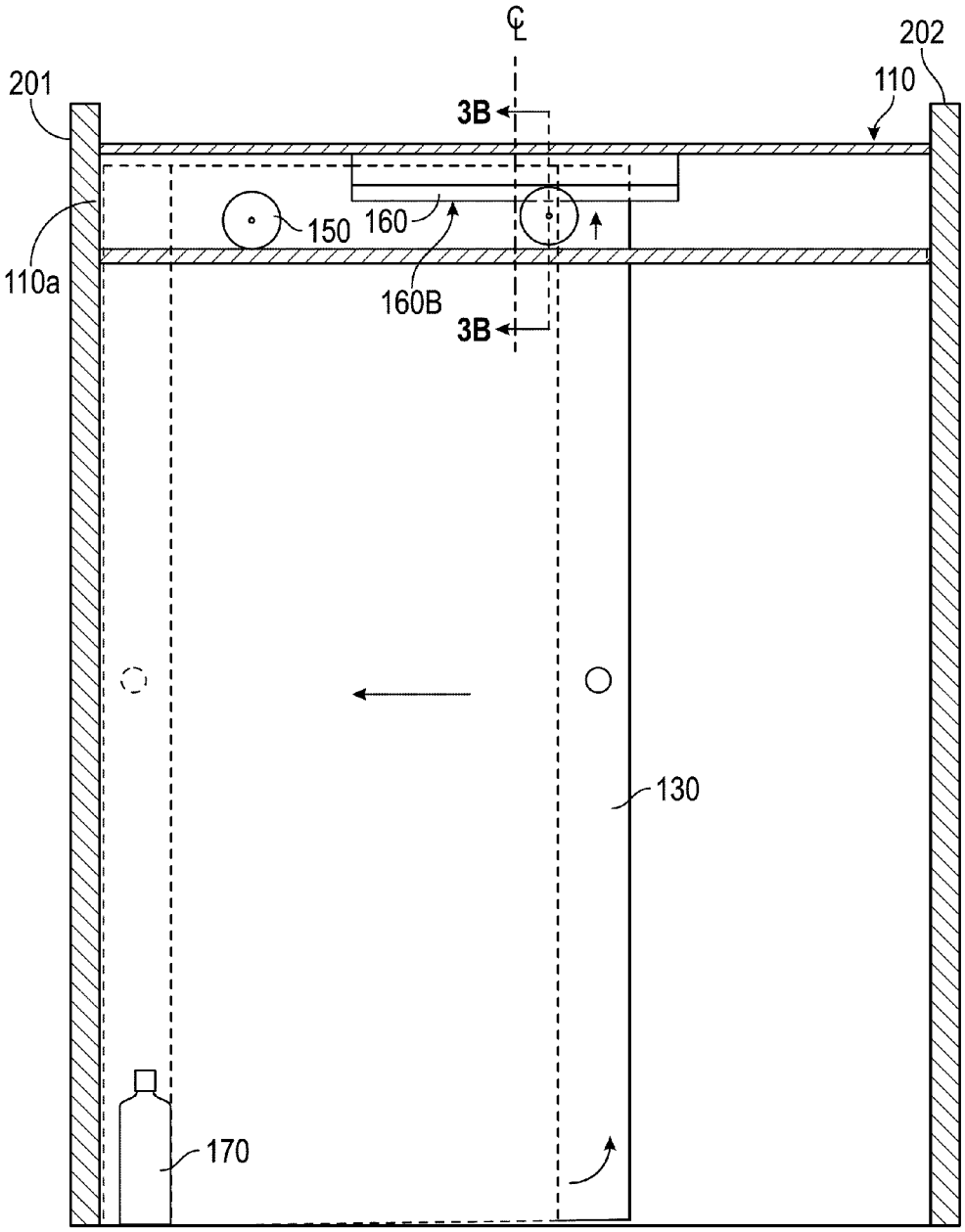
FIG. 2C is a partial cross-sectional view taken along line 2-2 in FIG. 1 showing a door panel at an instance when it is contacting an object while moving along a header, according to an exemplary embodiment.

For example, referring to FIG. 2C, if the door panel 130 is being moved in a direction from right to left (denoted by an arrow on door panel 130) and the door contacts an object 170 (e.g., a shampoo bottle, etc.) near the bottom of the door panel 130, the door panel will rotate in a counter-clockwise direction (denoted by an arrow on door panel 130), thereby causing the roller 150 located farthest from the direction of travel and nearest the center of the header 110 to move in an upward direction, as shown in FIG. 2C. However, in this situation, with the elongated member 160 located at the second position 160B, the roller 150 located farthest from the direction of travel will contact the elongated member 160, thereby impeding upward movement of the roller 150, because the roller 150 located farthest from the direction of travel is constrained by the elongated member 160. In this way, when the door panel 130 is moved (e.g., slid, rolled, translated, etc.) relative to the header 110, the elongated member 160 can substantially impede/reduce upward movement of the door 130, so as to completely prevent the door 130 from derailing from the header 110.

Figure 3A:
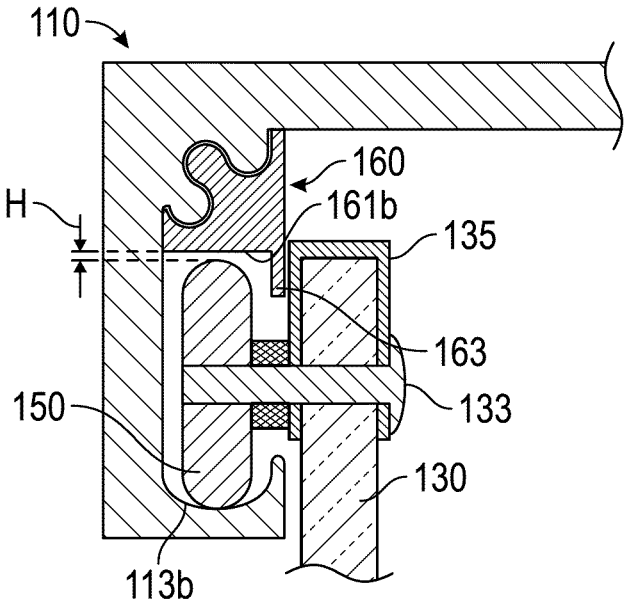
FIG. 3A is a partial cross-sectional view taken along line 3A-3A in FIG. 2B, according to an exemplary embodiment.

Referring now to FIG. 3A, which is a cross-sectional view taken along line 3A-3A in FIG. 2B, the shower door assembly 100 is shown with the elongated member 160 located at the second position 160B. The door panel 130 is in rolling engagement with a track defined by an engagement surface 113*b* of the header 110 via the roller 150. The door panel 130 includes a bracket 135 and a fastener shown as a pin 133 for rotatably coupling the roller 150 to the door panel 130. The elongated member 160 includes a bottom surface 161*b* disposed above the roller 150. The elongated member 160 also includes a leg 163 extending downward from the bottom surface 161*b*. When the elongated member 160 is at the second position 160B, there is a gap (e.g., space, clearance, etc.) H between the bottom surface 161*b* and an upper portion of the roller 150. The gap H is such that there is a clearance between the roller 150 and the elongated member 160 to permit relative movement of the roller 150 along the header 110 without any interference, but is small enough to prevent the roller 150 from moving in an upward direction or jumping off of the header 110.

Figure 3B:
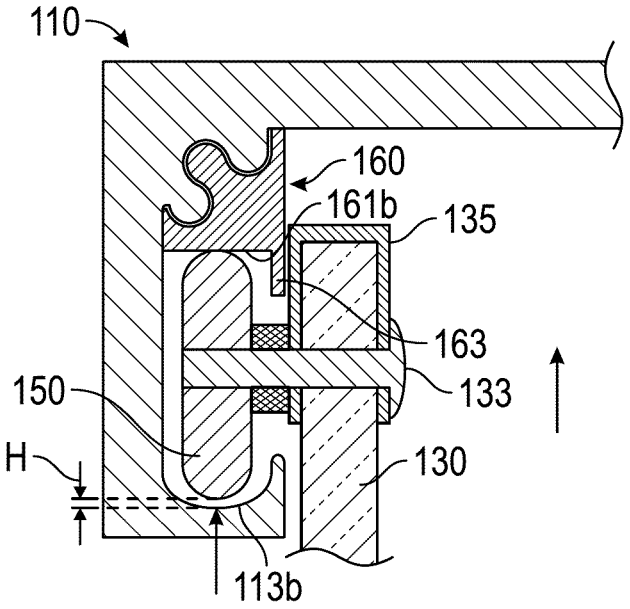
FIG. 3B is a partial cross-sectional view taken along line 3B-3B in FIG. 2C, according to an exemplary embodiment.

Referring now to FIG. 3B, which is a cross-sectional view taken along line 3B-3B in FIG. 2C, the shower door assembly 100 is shown at an instance when the door panel 130 is moving in a direction from right-to-left relative to the header 110, as explained above with respect to FIG. 2C. In this embodiment, the roller 150 shown in FIG. 3B is located farthest from the direction of travel of the door panel 130. The elongated member 160 is at the second position 160B within the header 110. As a result of the door panel 130 contacting an object 170 (e.g., a shampoo bottle, etc.) at a location near the bottom of the door, as explained above with respect to FIG. 2C, the door panel 130 rotates and the roller 150 moves in a generally upward direction (represented by arrows shown in FIG. 3B). However, because the roller 150 located farthest from the direction of travel is substantially constrained by the elongated member 160, the roller 150 moves a distance upward that is less than or equal to the gap H from the engagement surface 113*b* of the header 110. An upper portion of the roller 150 contacts the bottom surface 161*b* of the elongated member 160, thereby preventing/impeding the door panel 130 from further moving in an upward direction and from completely falling off (i.e., derailing) from the header 110.

Similarly, if the door panel 130 is pushed/pulled in a frontward or a backward direction (e.g., if a user pushes against the door panel 130 in a direction toward the inside of the shower enclosure), the elongated member 160 can act to substantially impede the front-to-back movement of the door, because the roller(s) 150 located nearest the center of the header 110 are substantially constrained by the elongated member 160 in this direction. That is to say, the leg 163 of the elongated member 160 substantially constrains the rollers 150 in the front-to-back direction along the header 110. In this way, the elongated member 160 substantially impedes/reduces the upward and/or front-to-back movement of the door panel 130 and helps to keep the door panel 130 in rolling (or sliding) engagement with the header 110.

Figure 4:
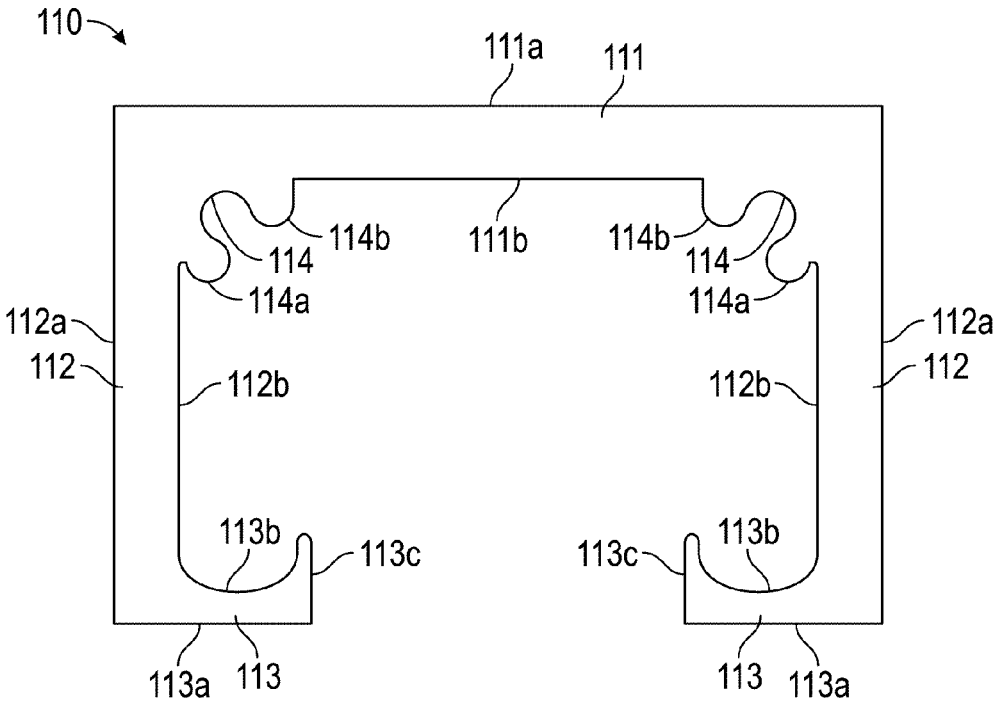
FIG. 4 is a side view of a header, according to an exemplary embodiment.

Referring now to FIG. 4, the header 110 is shown according to an exemplary embodiment. The header 110 has a generally rectangular cross-sectional shape. According to other exemplary embodiments, the header 110 can have a different cross-sectional shape, such as a circle, an octagon, or a similar shape. As shown in FIG. 4, the header 110 includes a top wall 111 and side walls 112. The top wall 111 includes an outer surface 111*a* and an inner surface 111*b*. Each of the side walls 112 includes an outer surface 112*a* and an inner surface 112*b*. The header 110 further includes bottom walls 113 extending from a lower portion of each of the side walls 112. Each of the bottom walls 113 includes an outer surface 113*a*, an engagement surface 113*b*, and an end surface 113*c*. The engagement surface 113*b* has a generally concave shape defining a track configured to receive a roller 150 of the door panel 130 thereon. According to other exemplary embodiments (not shown), the engagement surface 113*b* is generally flat.

Still referring to FIG. 4, the inner surfaces 112*b* each include a first protrusion 114*a* extending outwardly from an upper portion thereof. The inner surface 11 lb includes second protrusions 114*b* extending downward near each end of the top wall 111, adjacent the first protrusions 114*a*, respectively. The first protrusions 114*a* and the second protrusions 114*b* each have a profile that collectively defines a channel 114 configured to receive and retain the elongated member 160 within the header 110. The channels 114 are each disposed within an inner corner of the header 110 near the top wall 111 between the first and second protrusions 114*a* and 114*b*.

According to various exemplary embodiments, the header 110 is a conventional bypass header configured to be used in shower or bathing enclosures. The header 110 can be made (e.g., extruded, molded, etc.) from a rigid or a semi-rigid material or combinations of materials, such as aluminum, steel, plastic, or other material or combinations of materials suitable for the particular application of the header 110. According to an exemplary embodiment, the header 110 includes a mounting plate (not shown) located at each end of the header 110. The mounting plates are each configured to couple the header 110 to a fixed portion of the bathing enclosure or to a fixed portion of a building structure.

Figure 5:
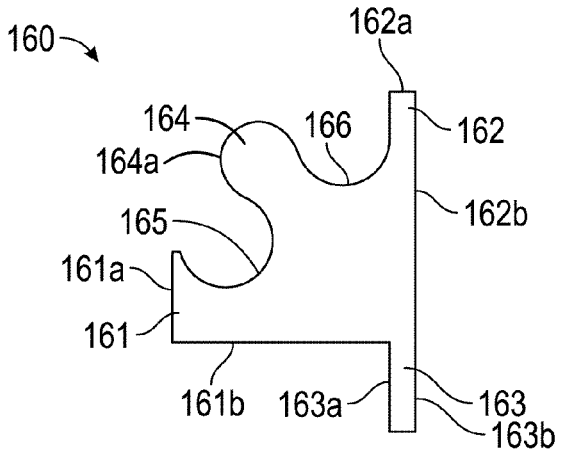
FIG. 5 is a side view of an elongated member, according to an exemplary embodiment.

Referring now to FIG. 5, the elongated member 160 is shown according to an exemplary embodiment. The elongated member 160 includes a side wall 162 and a bottom wall 161. A leg 163 extends downward from the bottom wall 161 and is located near the side wall 162. The leg 163 and the side wall 162 have a shared outer surface 162*b*. The leg 163 also includes an inner surface 163*a*. The side wall 162 includes a top surface 162*a*. The top surface 162*a* is configured to contact the inner surface 111*b* of the top wall 111 when the elongated member 160 is slidably coupled within the channel 114. As shown in FIG. 5, the bottom wall 161 includes a side surface 161*a* and a bottom surface 161*b*. The side wall 161*a* is configured to contact the inner surface 112*b* of the side wall 112 when the elongated member 160 is slidably coupled within the channel 114. The bottom wall 161 is configured to substantially reduce/impede upward movement of the roller 150 when the door panel 130 is moving along the header 110, such as, for example, if the door panel 130 contacts an obstruction or an object. Similarly, the leg 163 is configured to substantially reduce/impede front-to-back movement of the roller 150 when the door panel 130 is moving along the header 110, such as, for example, if the door panel 130 is pushed/pulled by a user in a frontward or a backward direction, perpendicular to the direction of travel along the header 110.

Still referring to FIG. 5, the elongated member 160 includes a protrusion 164 extending outwardly between the side wall 162 and the bottom wall 161. The protrusion 164 is defined by an arcuate surface 164*a*. A first portion of the arcuate surface 164*a* is connected to and extends from the bottom wall 161 by a first transition surface 165. A second portion of the arcuate surface 164*a* is connected to and extends from the side wall 162 by a second transition surface 166. The arcuate surface 164*a*, the first transition surface 165, and the second transition surface 166 collectively define a surface profile that is complementary to (i.e., substantially the same as) the surface profile defined by the first protrusion 114*a* and the second protrusion 114*b* of the header 110. In this way, the elongated member 160 can be slidably coupled within the header 110 by sliding the protrusion 164 within the channel 114 defined by the first and second protrusions 114*a* and 114*b*. According to other exemplary embodiments (not shown), the elongated member 160 can include different geometry for slidably coupling the elongated member 160 to the header 110, such as, for example, slots, protrusions, or the like.

Figure 6:
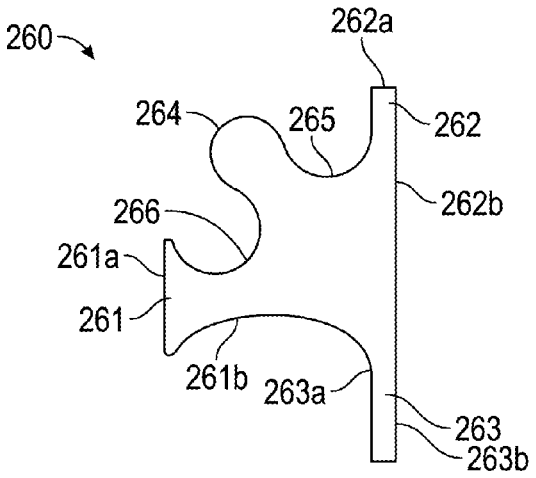
FIG. 6 is a side view of an elongated member, according to another exemplary embodiment.

According to various exemplary embodiments, the elongated member 160 can have a variety of shapes, sizes, and configurations that differ from the embodiment shown in FIGS. 1-3B and 5. For example, referring to FIG. 6, an elongated member 260 is shown according to another exemplary embodiment. In this embodiment, like reference numerals represent similar components, but are increased by an order of two (e.g., bottom wall 161 in FIG. 5 is analogous to bottom wall 261 in FIG. 6). In this exemplary embodiment, the elongated member 260 includes a bottom wall 261 having an arcuately shaped (e.g., concave shaped, etc.) bottom surface 261*b*. The bottom surface 261*b* has a concave surface profile that is complementary to, or is the same as, the profile of an upper portion of the roller 150. In this way, the bottom surface 261*b* can receive/contact the upper portion of the roller 150 when the door panel 130 contacts an object/obstruction while moving along the header 110. That is, the bottom surface 261*b* can help maintain a vertical and a front-to-back position of the roller 150 relative to the track defined by the engagement surface 213*b* by having a shape that is complementary to the shape of an upper portion of the roller 150. This configuration is particularly advantageous in that the position of the door panel 130 is maintained relative to the header 110 while it is in moving engagement with the header 110.

Figure 7:
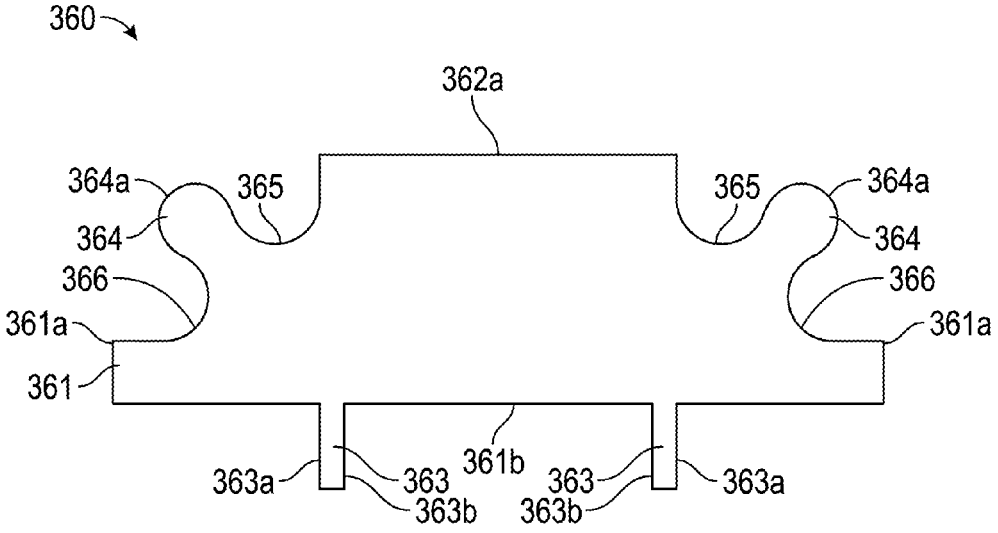
FIG. 7 is a side view of an elongated member, according to another exemplary embodiment.

Referring now to FIG. 7, an elongated member 360 is shown according to another exemplary embodiment. In this embodiment, like reference numerals represent similar components, but are increased by an order of three (e.g., bottom wall 161 in FIG. 5 is analogous to bottom wall 361 in FIG. 7). In this exemplary embodiment, a single adjustable elongated member 360 can be used within the header 110 to substantially impede/reduce upward and/or front-to-back movement of a pair of doors 130, without the need for additional elongated members. That is to say, the elongated member 360 replaces the pair of elongated members 160 shown in FIGS. 1, 3A-3B, and 5-6. As shown in FIG. 7, the elongated member 360 is similar to the embodiment shown in FIG. 5, but includes a second portion that is the mirror image of the elongated member 160 shown in FIG. 5. The top surface 362*a* extends across a width of the elongated member 360 to connect both portions of the elongated member 360. Likewise, the elongated member 360 includes a bottom surface 361*b* which extends across a width of the elongated member 360. The elongated member 360 is configured to be slidably coupled within the corresponding channels 114 of the header 110.

According to the various exemplary embodiments described above in FIGS. 5-7, the elongated member 160 can be made (e.g., extruded, molded, etc.) from a plastic material, such as nylon, ABS, or other similar plastic material or combinations of materials. According to other exemplary embodiments, the elongated member 160 is made from another type of rigid or semi-rigid material, such as a composite material, a metal, or any other rigid or semi-rigid material suitable for the particular application of the elongated member 160 within the header 110. According to an exemplary embodiment, the elongated member 160 is a single-piece extrusion.

Referring to FIGS. 2A-2B, an exemplary installation and removal sequence of the door panel 130 to/from the header 110 will now be described according to an exemplary embodiment. As shown in FIG. 2A, before the header 110 is installed to the fixed structure 200, two elongated members 160 are each slidably coupled from the ends of the header 110 within the respective channels 114. The assembly of the elongated members 160 within the header 110 is performed at the manufacturing site before the header 110 is shipped to an installer/user. Once the installer fixes/couples the header 110 to the fixed structure 200, the installer can move (e.g., slide, translate, etc.) each of the elongated members 160 to the first position 160A located near an end of the header 110, such as, for example, to the end 110*a* shown in FIG. 2A. By moving the elongated members 160 to the first position 160A, the user or installer creates an installation area suitable for installing the doors 130 onto the header 110. The installation area is clear of the elongated members 160 such that the rollers 150 can easily engage the track defined by the engagement surface 113*b* of the header 110 (see FIG. 4).

With each of the elongated members 160 at the first position 160A, the installer can install each of the door panels 130 onto the header 110 by engaging the respective rollers 150 with the track defined by the engagement surface 113*b*. The space between the engagement surface 113*b* and the first and second protrusions 114*a* and 114*b* is large enough to allow a user to easily install the door panel 130 to the track of the header 110. Next, the user or installer can selectively move (e.g., slide, translate, etc.) each of the elongated members 160 within the respective channels 114 to the second position 160B shown in FIG. 2B. In the second position 160B, each of the elongated members 160 is disposed above the roller(s) 150 of the door panels 130 such that the roller(s) 150 located nearest the center of the opening are constrained by the elongated members 160. Accordingly, when the door panels 130 are moved between an open and a closed position, the elongated members 160 can act to impede undesired upward and/or front-to-back movement of the door panel 130 relative to the header 110. This facilitates smoother and more consistent operation of the door when a user or installer moves the door between an open and a closed position.

If the user or the installer chooses to remove one or more of the door panels 130 from the header 110, such as during maintenance or repair, the user or installer can selectively move the associated elongated member 160 from the second position 160B (shown in FIG. 2B) to the first position 160A (shown in FIG. 2A). By moving the elongated member back to the first position 160A, the user or the installer creates an area suitable to facilitate the removal of the door panel 130 from the header 110. That is, the rollers 150 can move in an upward direction to disengage from the track of the header 110. In this way, the elongated member 160 provides for improvements relating to the removal of doors from shower door assemblies.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the application as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement as illustrated for the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements illustrated as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present application.

What is claimed is:

1. A shower door assembly comprising:

a header including a track and a channel disposed above the track;

a door in moving engagement with the track; and an elongated member received within and slidably coupled to the channel and configured to be slid within the channel between a first position to allow for removal of the door from the track and a second position to substantially impede upright movement of the door when the door is moved along the track between an open and a closed position.

2. The shower door assembly of claim 1, wherein the door includes a plurality of rolling members in rolling engagement with the track, wherein when the elongated member is at the first position, a gap is created within the header between the track and the channel to allow for removal of the plurality of rolling members from the track.

3. The shower door assembly of claim 2, wherein when the elongated member is at the second position, at least one of the plurality of rolling members located nearest the center of the header is substantially constrained by the elongated member to prevent the at least one of the plurality of rolling members from jumping off of the track when the door is moved along the track.

4. The shower door assembly of claim 1, wherein the elongated member is further configured to substantially impede lateral movement of the door when the elongated member is at the second position.

5. The shower door assembly of claim 1, wherein the elongated member has a length that is less than half of an overall length of the header.

6. The shower door assembly of claim 1, wherein the first position is located at an end of the header, and wherein the second position is located at a middle portion of the header.

7. The shower door assembly of claim 1, wherein the channel is located near and upper inside corner of the header.

8. A shower assembly comprising:

a header including a track and a channel disposed above the track; and an elongated member received within and slidably coupled to the channel and configured to be slid within the channel between a first position to allow for installation or removal of a door to or from the track and a second position to substantially impede upright movement of the door while the door is in moving engagement with the track;

wherein the first position is located at an end of the header, and wherein the second position is located at a middle portion of the header.

9. The shower assembly of claim 8, wherein the elongated member is further configured to substantially impede lateral movement of the door when the elongated member is at the second position.

10. The shower assembly of claim 8, wherein the elongated member has a length that is less than half of an overall length of the header.

11. The shower assembly of claim 8, further comprising a door in moving engagement with the track.

12. The shower assembly of claim 11, wherein the door includes a plurality of rolling members in rolling engagement with the track, wherein when the elongated member is at the first position, a gap is created within the header between the track and the channel to allow for removal of the plurality of rolling members from the track.

13. The shower assembly of claim 12, wherein when the elongated member is at the second position, at least one of the plurality of rolling members located nearest the center of the header is substantially constrained by the elongated member to prevent the at least one of the plurality of rolling members from jumping off of the track when the door is moved along the track.

14. A shower door assembly comprising:

a header including a track and a channel located above the track;

a door in moving engagement with the track; and an elongated member received within and slidably coupled to the channel and configured to be moved within the channel between an end of the header to allow for installation or removal of the door to or from the track and a middle portion of the header to substantially impede upright movement of the door while the door is being moved along the track between an open and a closed position.

15. The shower door assembly of claim 14, wherein the door includes a plurality of rolling members in rolling engagement with the track, and wherein when the elongated member is at the end of the header, a gap is created within the header between the track and the channel to allow for removal of the plurality of rolling members from the track.

16. The shower door assembly of claim 15, wherein when the elongated member is at the middle portion of the header, at least one of the plurality of rolling members located nearest the center of the header is substantially constrained by the elongated member to prevent the at least one of the plurality of rolling members from jumping off of the track when the door is moved along the track.

17. The shower door assembly of claim 14, wherein the elongated member is further configured to substantially impede lateral movement of the door when the elongated member is at the middle portion of the header.

18. The shower door assembly of claim 14, wherein the elongated member has a length that is less than half of an overall length of the header.

19. The shower door assembly of claim 14, wherein the channel is located near an upper inside corner of the header.

20. The shower door assembly of claim 14, wherein the elongated member is configured to be slid within the channel.

* * * * *